343-700 MS AU 256 EX
5/20/80 OR 4,204,212

United States Patent [19]
Sindoris et al.

[11] 4,204,212
[45] May 20, 1980

[54] CONFORMAL SPIRAL ANTENNA

[75] Inventors: Arthur R. Sindoris, Cary, N.C.; Frederick G. Farrar, Kensington; Daniel H. Schaubert, Silver Spring, both of Md.

[73] Assignee: The United States of America as represented by the Secretary of the Army, Washington, D.C.

[21] Appl. No.: 966,839

[22] Filed: Dec. 6, 1978

[51] Int. Cl.[2] ..... H01Q 1/38
[52] U.S. Cl. ..... 343/700 MS; 343/895; 343/830
[58] Field of Search ..... 343/700 MS, 895, 846, 343/829, 830

[56] References Cited

U.S. PATENT DOCUMENTS

| | | | |
|---|---|---|---|
| 3,713,166 | 1/1973 | Munson et al. | 343/700 MS |
| 3,778,717 | 12/1973 | Okoshi et al. | 343/700 MS |
| 4,032,921 | 6/1977 | Sikina, Jr. | 343/895 |
| 4,083,046 | 4/1978 | Kaloi | 343/700 MS |

*Primary Examiner*—David K. Moore
*Attorney, Agent, or Firm*—Nathan Edelberg; Robert P. Gibson; Saul Elbaum

[57] ABSTRACT

An electrically small, microstrip radiator designed for small-diameter missile applications. The preferred embodiment comprises a cylindrical tube of epoxy fiberglass dielectric having a spiral conducting strip formed thereon. The tubular construction permits the antenna to be conformally mounted to the surface of the missile. RF input coupling may be achieved by an inductive post, and high radiation efficiency is obtained by strongly coupling RF currents to the body of the missile and exciting the dipolar mode of radiation. The design includes means for mechanically tuning the antenna over a narrow frequency range. The resultant spiral-slot antenna produces an axially polarized radiation field and a dipole radiation pattern with isotropic gain in a low cost and rugged construction.

9 Claims, 4 Drawing Figures

CONFORMAL SPIRAL ANTENNA

RIGHTS OF THE GOVERNMENT

The invention described herein may be manufactured, used, and licensed by or for the United States Government for governmental purposes without the payment to us of any royalties thereon.

BACKGROUND OF THE INVENTION

The present invention is related to antennas and, more particularly, is directed towards a conformal microstrip antenna designed in particular to be utilized on a missile or projectile which requires an electrically small construction.

A typical prior art antenna utilized for a telemetry system in a missile consists of a loop antenna comprising a plurality of turns of conducting wire wrapped about the nose section of the missile. A common requirement of such antennas is that they be electrically small, i.e. their maximum dimension be less than a tenth of a wavelength.

Such wire loop antennas characteristically exhibit low gain and an extremely narrow band impedance match. Additionally, the configuration of most of the electrically small antennas of the prior art leads to poor radiation characteristics since, due to their small size, there may be created high current densities, which lead to high $I^2R$ losses. The electric field of such wire loop antennas is generally polarized transverse to the axis of the missile.

We realized that if the field of the antenna could be polarized axially, currents could be excited along the missile by using the missile body as part of the metallic structure of the antenna to therefore spread out the current density and lower the $I^2R$ losses, thereby increasing the efficiency of the radiator. In addition to being electrically small, the resultant design had to be compatible with the nose section of the missile, hollow in the center to permit passage of the missile body and/or wires to the telemeter transmitter, and had to be relatively small in diameter and length.

The present invention was advanced with a view towards meeting the above design criteria.

OBJECTS AND SUMMARY OF THE INVENTION

It is therefore a primary object of the present invention to provide an electrically small antenna for a missile which overcomes all of the disadvantages noted above with respect to the prior art antennas.

Another object of the present invention is to provide an electrically small antenna which is compatible with the nose section of a missile, which is hollow in the middle, and which is of relatively small size.

A further object of the present invention is to provide an electrically small antenna which may be mass produced at low cost, and which includes means for adjusting the frequency thereof after manufacture.

An additional object of the present invention is to provide an electrically small antenna which has an improved gain level over the prior art resonant loop antennas, and which may be easily fabricated by known techniques.

A still further object of the present invention is to provide an electrically small, microstrip antenna which is highly reliable, rugged, lowcost, and which is capable of withstanding high acceleration and radiating high levels of RF power.

The foregoing and other objects are attained in accordance with one aspect of the present invention through the provision of a microstrip antenna which comprises a substantially cylindrical dielectric tube having inner and outer cylindrical surfaces, a conductive ground plane formed on the inner surface of the dielectric tube, and a strip of conductive material formed in a spiral on the outer surface of the dielectric tube. The tube includes a pair of end walls connecting the inner and outer surfaces, and at least one of the end walls is covered by a conductive material which electrically connects the spiral strip to the ground plane. The other of the end walls may also be covered by conductive material, and an inductive feed post may be provided for driving the spiral strip. The feed post more particularly comprises a coaxial cable or connector whose outer conductor is connected to the conductive ground plane and whose inner conductor extends through the tube and is connected to the spiral strip, an insulator being positioned between the inner and outer conductors. The feed post is preferably positioned on the longitudinal center line of the spiral strip, midway between the side edges thereof.

In accordance with another aspect of the present invention, the spiral strip is shaped when unwound from the tube as a parallelogram having parallel upper and lower edges, and parallel side edges, the upper and lower edges also being parallel to the end walls of the tube when positioned thereon. The lower edge of the strip contacts the conductive material on the first end wall of the tube, while the upper edge of the strip is spaced from the conductive material covering the other end wall so as to form a radiating slot aperture for the antenna therebetween.

In accordance with another aspect of the present invention, the spiral strip includes means for tuning the frequency of the antenna by trimming certain portions of the strip. Such portions are defined by a junction between one of the upper edges and one of the side edges of the parallelogram strip, another portion being defined by a junction between the lower edge and the same side edge of the strip. Trimming of the first junction increases the frequency of the antenna, while trimming of the second junction decreases the antenna frequency.

BRIEF DESCRIPTION OF THE DRAWINGS

Various objects, features and attendant advantages of the present invention will be more fully appreciated as the same becomes better understood from the following detailed description of the present invention when considered in connection with the accompanying drawings, in which.

DETAILED DESCRIPTION OF THE PREFERRED EMBODIMENT

Figure 1:
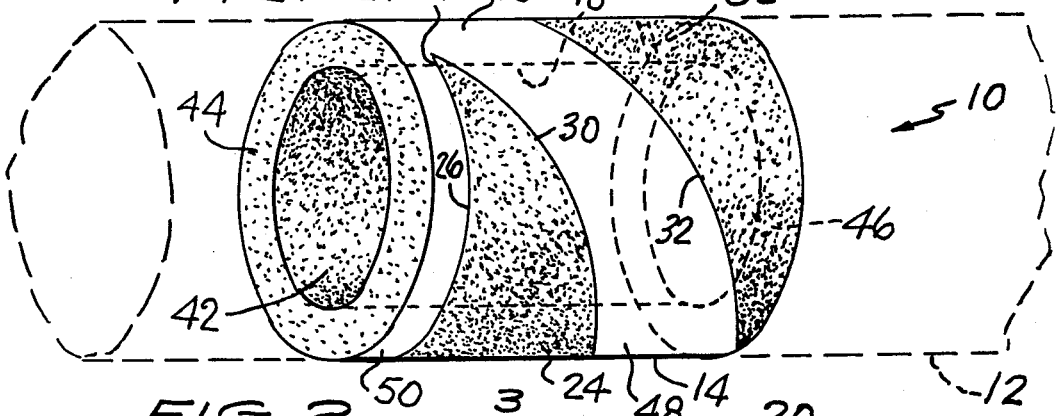
FIG. 1 is perspective view of a preferred embodiment of the antenna of the present invention shown as mounted on the body of a missile.

Referring now to the drawings, wherein like reference numerals represent identical or corresponding parts throughout the several views, and more particularly to FIG. 1 thereof, the conformal antenna of the present invention is indicated generally by reference numeral 10.

Antenna 10 is shown mounted in the cylindrical body 12 of a missile and serves as a transmitting or receiving antenna for an internally mounted telemetry system, or the like. For that purpose, the body of the antenna 10 must be hollow, and therefore comprises a cylindrical tube 14 constructed of a suitable dielectric material such as, for example, epoxy fiberglass.

Figure 3:
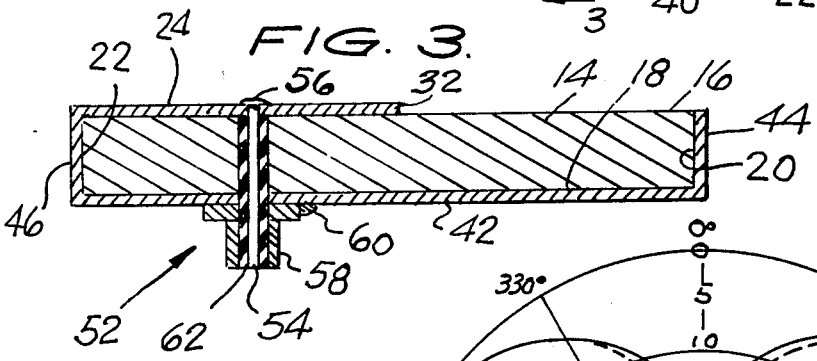
FIG. 3 is a cross-sectional view of the structure illustrated in FIG. 2 and taken along line 3—3 thereof.

FIG. 3 in effect illustrates a longitudinal sectional view through one side of the antenna 10 of FIG. 1. The cylindrical dielectric tube 14 is seen to comprise an outer cylindrical surface 16 and an inner cylindrical surface 18. The outer and inner surfaces 16 and 18 are connected by end walls 20 and 22 of the cylindrical tube 14. End walls 20 and 22 are planar and substantially parallel to one another.

Figure 2:
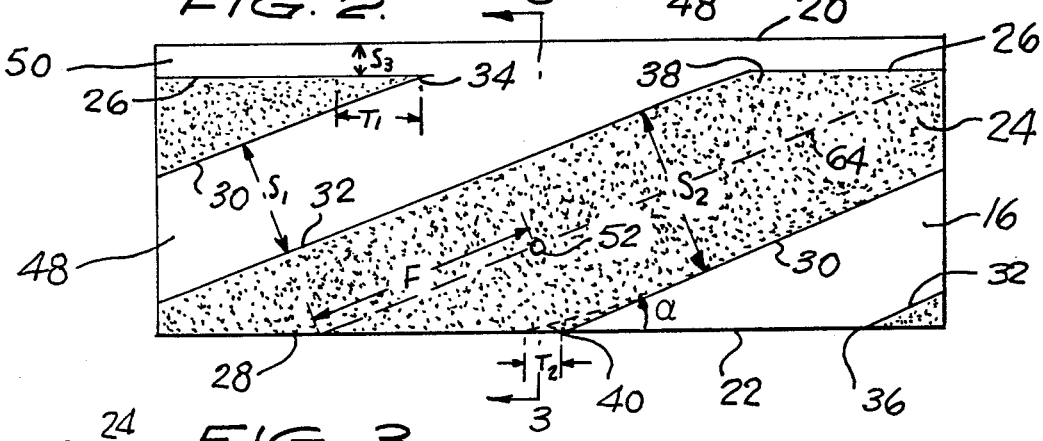
FIG. 2 is a plan view of the antenna structure illustrated in FIG. 1 but shown unwound from the cylindrical configuration.

Formed on the outer surface 16 of tube 14 is a thin sheet of conductor, such as copper, which is wrapped in a spiral fashion about outer surface 16. As illustrated in FIG. 2, the spiral conductor 24, when unwound, is shaped as a parallelogram having upper and lower parallel edges 26 and 28, respectively, and parallel side edges 30 and 32. Upper edge 26 and side edge 30 meet at a tip 34 forming one acute angle corner of the parallelogram structure, while the upper edge 26 meets the other side edge 32 at a tip 38 forming an obtuse angle of the conductor 24. Similarly, the lower edge 28 meets side edge 32 at a junction or tip 36 forming an acute angle of conductor 24, while lower edge 28 meets the other side edge 30 at a junction indicated by reference numeral 40 which forms an obtuse angle of conductor 24. The junction portions 34, 36, 38 and 40 form tuning means for the antenna 10, in a manner which will be described in greater detail hereinafter. Note also that the edge 30 of conductor 24 makes an angle $\alpha$ with the end wall 22 which defines the slope and height of the antenna.

The entire inner surface 18 of cylindrical tube 14 is covered with a conductive ground plane 42, such as copper. The end walls 20 and 22 of tube 14 are also covered by conductors 44 and 46 which prevent radiation from the end walls and also establish a good electrical contact with the body of the missile 12.

As may be seen in FIGS. 1 and 2, the outer surface 16 of the dielectric tube 14 may be thought of as including a spiral section 48 and a circumferential section 50. The circumferential section 50 extends between the upper edge 26 of spiral conductor 24 and the conductive end wall 44 of tube 14. The circumferential section 50 thereby forms the radiating slot aperture for the antenna 10. The thickness S3 of the aperture 50 is approximately the same as the wall thickness of the tube 14, while the spiral separation distance S1 and spiral width S2 are adjusted empirically to achieve a desired design. Broadly, the spiral separation S1 is maintained as large as possible to minimize coupling between the two portions of the spiral patch, while the spiral width S2 is also kept as wide as possible in order to make the total radiating aperture as wide as possible. Clearly, the distances S1 and S2 must be compromised for any particular design.

An inductive, RF feed post is indicated generally by reference numeral 52 and is inserted through the wall of the dielectric tube 14 to be connected to the spiral conductor 24. More particularly, feed post 52 may include a coaxial cable or connector whose center conductor 54 is connected to the spiral 24 as by solder post 56, while the outer conductor 58 is connected to the ground plane 42 by solder connection 60. Insulation 62 separates the center conductor 54 from the outer conductor 58. Note that the antenna 10 may be directly coupled to a coaxial transmission line without requiring an RF connector.

The antenna 10 of the present invention may be manufactured by well known techniques. For example, the dielectric tube 14 is initially machined to the desired dimensions to conform to the missile or projectile 12 in which the antenna is to be mounted. A slot-pattern mask is applied to the tube 14, after which the tube 14 is flashed with copper in an electroless-plating process. The mask is then removed and a thin layer of approximately 0.05 millimeters of copper is electroplated onto the antenna. The feedpost and coaxial cable are then connected, and the antenna is ready for testing and tuning, if necessary.

The spiral-slot antenna 10 is the electrical equivalent of a transversely oriented, half wavelength resonant slot antenna backed by a quarter wavelength cavity, but is physically much smaller. The maximum dimension of the antenna 10 is less than a tenth of a wavelength. Three features make the antenna 10 of the present invention electrically small. First, a quarter wavelength microstrip radiator is the basic radiating element. In the present invention, one end of the section of microstrip line transmission is grounded to form a single radiating slot and approximately a quarter wavelength section of short-circuited transmission line or microstrip resonant cavity. Second, a moderate dielectric constant material, such as epoxy fiberglass ($\epsilon_r=4.3$) is the substrate dielectric for the microstrip transmission line which decreases the dimensions of the antenna by a factor of slightly more than 2. Third, instead of orienting the resonant dimension of the microstrip radiator parallel to the axis of the cylinder to obtain the desired polarization, the microstrip transmission line is spiralled around the cylinder. The spiral reduces the axial dimension required for the antenna by a factor of almost three.

Figure 4:
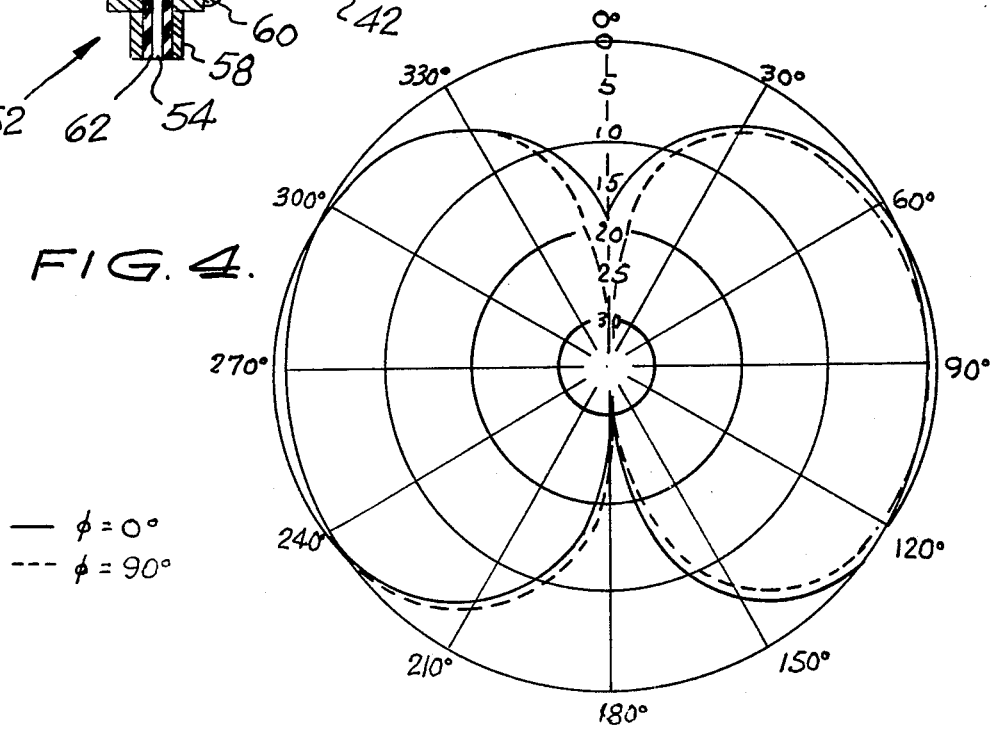
FIG. 4 is a graph illustrating the radiation pattern of the preferred embodiment of the present invention illustrated in FIG. 1.

The gain and radiation pattern of a typical antenna built in accordance with the present invention is illustrated in FIG. 4. The electric field is polarized parallel to the axis of the cylinder 14. The $\phi=0°$ pattern is a cut through the axis in the plane of the inductive feed post. The $\phi=90°$ pattern is in the orthogonal plane. The roll plane pattern at $\phi=90°$ (the plane orthogonal to the axis) shows less than one dB deviation from a perfect circle. The peak gain of approximately +1 dBi is just one dB less than the maximum possible from a dipole antenna, thereby indicating the antenna of the present invention is a highly efficient radiator. The cross-polarized field component is 10 to 15 dB below the principal component and is probably the main contributing factor to the 1 dB loss in gain.

A prototype model of the present invention which exhibited the radiation pattern of FIG. 4 was designed to operate in the UHF band at a frequency of 238 MHz on a 7.5 cm diameter missile. The input impedance was well matched to 50 ohms, displaying a 1.2:1 VSWR, while the VSWR is less than 2:1 over a band width of 4

MHz. Other impedances in the range of 10 ohms to a few hundred ohms can be matched through an adjustment in the location of the inductive feedpost 52. The prototype antenna was electrically small and had the following dimensions: a height of 0.06 λ, a diameter of 0.06 λ, and a wall thickness of 0.01 λ.

Referring to FIG. 2, the circumference of the antenna of the prototype was 23.9 cm while the height was 7.6 cm. The circumference and height are normally fixed by the diameter of the missile and the surface area allocated to the antenna. The length of the section of microstrip transmission line along the center line 64 sets the resonant frequency of the antenna. For the prototype model operating at 238 MHz, the distance of center line 64 was 21 cm, S1 was 2.7 cm, and S2 was 4.6 cm. The angle $\alpha$ of the spiral was 18°. The height of the antenna may be decreased by decreasing the angle $\alpha$, although a reduction in height has been demonstrated to cause a slight loss in gain by decreasing the radiation efficiency of the antenna. The thickness of the dielectric tube is also important, and we have demonstrated that decreasing the thickness from 1.25 cm to 0.6 cm causes a 4 dB loss in gain. The slot width S3 also affects the radiation efficiency of the antenna, and we have demonstrated that making the slot smaller than 1 cm at the prototype operating frequency causes a loss in gain. The dimension F from the lower edge 28 along the center line 64 to the feedpost 52 is used to adjust the impedance level. With F=7.0 cm, the input resistance of the antenna at resonance is about 55 ohms. Decreasing F decreases the resistance, while increasing F increases the resistance. This permits systems of other than 50 ohms nominal impedance levels to be easily matched to the antenna of the present invention.

The corner portions 34 and 40 of the preferred embodiment provide means for tuning the antenna of the present invention over a small frequency range after manufacture has been completed. For example, by increasing $T_1$ as measured from corner 34, the resonant frequency is increased. By increasing $T_2$ as measured from corner 40, the resonant frequency may be decreased. In the prototype model, for each millimeter increase in $T_1$, the resonant frequency will increase 0.3 to 0.5 MHz and the return loss will not change appreciably. Each increase of a millimeter in dimension $T_2$ produced a 1 MHz decrease in frequency and also degraded somewhat the impedance match. It is preferred to produce the antenna of the present invention to resonate slightly below the desired frequency and trim $T_1$ as needed during testing to raise the frequency and thus to compensate for any detuning effects caused by variations in the conductor dimensions and the dielectric constant of the epoxy fiberglass. The corners 36 and 38 effect the antenna resonance in a similar fashion to corners 34 and 40, respectively.

The present invention provides a thin-wall dielectric tube of the same outer diameter as the missile to thereby permit the antenna to mount flush or conformal with the missile surface. The antenna intrudes only minimally into the interior volume of the missile, and therefore only a small decrease in missile diameter is needed to accomodate the thin wall of the antenna. Electrically insulating the two sections of the missile is not required as in some types of prior art antennas. Printed circuit fabrication techniques maintain a low cost per unit, and the simplicity of the structure insures high reliability. The epoxy fiberglass dielectric produces an extremely rugged antenna that requires no additional mechanical support from the missile structure. The present invention may replace a resonant loop antenna in many missile applications and provide an improved gain level that is typically 10 dB and as much as 30 dB higher than the gain of the loop antenna.

Obviously, numerous modifications and variations of the present invention are possible in light of the above teachings. It is therefore to be understood that within the scope of the appended claims, the invention may be practiced otherwise than as specifically described herein.

We claim as our invention:

1. An electrically small microstrip antenna, which comprises:

a substantially cylindrical dielectric tube having inner and outer cylindrical surfaces;

a conductive ground plane formed on said inner cylindrical surface of said dielectric tube;

a strip of conductive material formed in a spiral on said outer cylindrical surface of said dielectric tube so that portions of said outer surface include exposed dielectric; and input feed means connected to said spiral strip of conductive material for driving same.

2. A microstrip antenna as set forth in claim 1, wherein said tube includes a pair of end walls connecting said inner and outer surfaces, at least one of said end walls being covered by a conductive material which electrically connects said strip to said ground plane.

3. A microstrip antenna as set forth in claim 2, further comprising conductive material which covers the other of said end walls.

4. A microstrip antenna as set forth in claim 1, wherein said input feed means comprises a coaxial cable whose outer conductor is connected to said conductive ground plane and whose inner conductor extends through said tube and is connected to said strip, an insulator being positioned between said inner and outer conductors.

5. A microstrip antenna as set forth in claim 1, wherein said input feed means is positioned on the longitudinal centerline of said strip, midway between the side edges thereof.

6. A microstrip antenna as set forth in claim 3, wherein said strip is shaped when unwound from said tube as a parallelogram having parallel upper and lower edges, and parallel side edges, said upper and lower edges also being parallel to said end walls of said tube when positioned thereon.

7. A microstrip antenna as set forth in claim 6, wherein said lower edge of said strip contacts said conductive material on said at least one of said end walls of said tube, and said upper edge of said strip is spaced from said conductive material covering said other of said end walls so as to form a radiating slot aperture for said antenna therebetween.

8. A microstrip antenna as set forth in claim 6, wherein said strip includes means for tuning the frequency of said antenna by trimming certain portions of said strip, said portions defined by a first junction between said upper edge and one of said side edges, and a second junction between said lower edge and the same one of said side edges.

9. A microstrip antenna as set forth in claim 8, wherein trimming of said first junction increases the frequency of said antenna, while trimming of said second junction decreases the frequency of said antenna.

* * * * *

Disclaimer 4,204,212.—*Arthur R. Sindoris,* Cary, N.C., *Frederick G. Farrar,* Kensington, and *Daniel H. Schaubert,* Silver Spring, Md. CONFORMAL SPIRAL ANTENNA. Patent dated May 20, 1980. Disclaimer filed Aug. 11, 1981, by the assignee, *The United States of America as represented by the Secetary of the Army.*

Hereby enters this disclaimer to claims 1-2 and 4-5 of said patent.

[*Official Gazette October 13, 1981.*]